US005513955A

United States Patent [19]

Barcza

[11] Patent Number: 5,513,955

[45] Date of Patent: May 7, 1996

[54] TURBINE ENGINE ROTOR BLADE PLATFORM SEAL

[75] Inventor: William K. Barcza, Palm City, Fla.

[73] Assignee: United Technologies Corporation, Hartford, Conn.

[21] Appl. No.: 355,800

[22] Filed: Dec. 14, 1994

[51] Int. Cl.[6] ..... F01D 5/18

[52] U.S. Cl. ..... 416/95; 416/193 A

[58] Field of Search ..... 416/95, 190, 193 A, 416/221, 500

[56] References Cited

U.S. PATENT DOCUMENTS

| | | | |
|---|---|---|---|
| 3,112,915 | 12/1963 | Morris . | |
| 3,266,770 | 8/1966 | Harlow . | |
| 3,610,778 | 10/1971 | Suter . | |
| 3,666,376 | 5/1972 | Damlis . | |
| 3,709,631 | 1/1973 | Karstensen et al. . | |
| 3,751,183 | 8/1973 | Nichols et al. . | |
| 3,887,298 | 6/1975 | Hess et al. . | |
| 4,182,598 | 1/1980 | Nelson . | |
| 4,280,795 | 7/1981 | Trousdell . | |
| 4,347,040 | 8/1982 | Jones et al. . | |
| 4,422,827 | 12/1983 | Buxe et al. . | |
| 4,455,122 | 6/1984 | Schwarzmann et al. . | |
| 4,494,909 | 1/1985 | Forestier . | |
| 4,505,642 | 3/1985 | Hill . | |
| 4,568,247 | 2/1986 | Jones et al. . | |
| 4,872,810 | 10/1989 | Brown et al. . | |
| 4,872,812 | 10/1989 | Hendley et al. . | |
| 5,261,790 | 11/1993 | Dietz et al. . | |
| 5,281,097 | 1/1994 | Wilson et al. | 416/193 A |
| 5,302,085 | 4/1994 | Dietz et al. . | |
| 5,313,786 | 5/1994 | Chlus et al. . | |
| 5,415,526 | 5/1995 | Mercadante et al. | 416/193 A |

FOREIGN PATENT DOCUMENTS

| | | | |
|---|---|---|---|
| 60-22002 | 2/1985 | Japan | 416/193 A |

*Primary Examiner*—Edward K. Look
*Assistant Examiner*—James A. Larson
*Attorney, Agent, or Firm*—Richard D. Getz

[57] ABSTRACT

An apparatus for sealing a gap between adjacent blades in a rotor assembly for a gas turbine engine is provided. The rotor assembly includes a plurality of blades circumferentially disposed around a disc. Each of the blades includes an airfoil, a root, and a platform extending outward in a lateral direction in a transition area between the root and the airfoil. The disc includes a plurality of complementary recesses circumferentially distributed around the disc for receiving the blade roots. The gaps are formed between edges of adjacent platforms. The platforms collectively form a flow path for primary fluid flow passing by the airfoil side of the platforms and secondary fluid flow passing by the root side of the platforms. The apparatus comprises a thin plate body and apparatus for conducting secondary flow between the thin plate body and root side surfaces of adjacent blade platforms, and thereafter into the gap. The secondary flow traveling between the thin plate body and the root side surfaces transfers thermal energy away from the platforms.

2 Claims, 3 Drawing Sheets

TURBINE ENGINE ROTOR BLADE PLATFORM SEAL

The invention was made under a U.S. Government contract and the Government has rights herein.

BACKGROUND OF THE INVENTION

1. Technical Field

This invention applies to turbine engine rotor assemblies in general, and to apparatus for sealing between adjacent rotor blades within a turbine engine rotor assembly in particular.

2. Background Information

Turbine and compressor sections within an axial flow turbine engine generally include a rotor assembly comprising a rotating disc and a plurality of rotor blades circumferentially disposed around the disc. Each rotor blade includes a root, an airfoil, and a platform positioned in the transition area between the root and the airfoil. The roots of the blades are received in complementary shaped recesses within the disc. The platforms of the blades extend laterally outward and collectively form a flow path for the fluids passing through the turbine. A person of skill in the art will recognize that it is a distinct advantage to control the passage of fluid from one side of the platforms to the other side of the platforms via gaps between the platforms. To that end, it is known to place a seal between the blade platforms to control such fluid leakage.

During the operation of the turbine engine, air flow on the airfoil side of the platforms (generally referred to as "primary flow") is at a significantly higher temperature than airflow passing by on the root side of the platforms (generally referred to as "secondary flow"). The high temperature primary flow, the temperature gradient across the platform, and the lack of platform cooling in most blade designs combine to produce high thermal stresses within the platforms which can cause stress cracks. To alleviate the stress, it is known to bleed the lower temperature secondary flow through small apertures within the platform. This solution does help to reduce the thermal gradients across the blades and therefore reduce the thermal stresses within the platforms. There is a limit, however, to the amount of leakage that may pass through the platforms using this method.

Upstream of the turbine stages of the engine, work imparted to the secondary flow by the compressor stages of the engine increases the pressure of the secondary flow. Passing secondary flow through platform apertures loses some of that imparted work and therefore decreases the efficiency of the engine. To minimize the loss of work while optimizing the cooling done by the secondary flow, it is known to use a greater number of smaller diameter apertures, rather than a fewer number of larger diameter holes. Decreasing the diameter of the hole, however, increases the stress concentration about that hole. Hence, there is a tension between the benefits of cooling and the detriments of cooling holes using the aforementioned method.

In sum, what is needed is a means for sealing between adjacent rotor blades in a turbine engine rotor assembly which alleviates the formation of thermal stress within the blade platforms and which does not appreciably reduce the efficiency of the engine.

DISCLOSURE OF THE INVENTION

It is, therefore, an object of the present invention to provide a means for sealing between adjacent rotor blades.

It is still another object of the present invention to provide means for dissipating thermal energy within a blade platform.

It is still another object of the present invention to provide a means for reducing thermal stress within blade platforms.

It is still another object of the present invention to dissipate thermal energy within the blade platforms without negatively affecting the efficiency of the engine.

According to the present invention, an apparatus for sealing a gap between adjacent blades in a rotor assembly for a gas turbine engine is provided. The rotor assembly includes a plurality of blades circumferentially disposed around a disc. Each of the blades includes an airfoil, a root, and a platform extending outward in a lateral direction in a transition area between the root and the airfoil. The disc includes a plurality of complementary recesses circumferentially distributed around the disc for receiving the blade roots. The gaps are formed between edges of adjacent platforms. The platforms collectively form a flow path for primary fluid flow passing by the airfoil side of the platforms and secondary fluid flow passing by the root side of the platforms. The apparatus comprises a thin plate body and means for conducting secondary flow between the thin plate body and root side surfaces of adjacent blade platforms, and thereafter into the gap. The secondary flow traveling between the thin plate body and the root side surfaces transfers thermal energy away from the platforms.

An advantage of the present invention is that platform cooling is provided without adding stress rising apertures in the platform.

A further advantage of the present invention is that the heat transfer for a particular flow of secondary fluid is optimized. In the present invention, secondary flow is drawn between the thin plate body of the seal and the root side surface of each platform before exiting through the gap. The flow pattern between the two surfaces increases the heat transfer from the platforms to the secondary flow.

A still further advantage of the present invention is that the means for transferring thermal energy from the platforms to the secondary fluid does so at minimal energy losses to the engine.

A still further advantage of the present invention is that the platform cooling means of the present invention is considerably less expensive than prior art cooling means.

These and other objects, features and advantages of the present invention will become apparent in light of the detailed description of the best mode embodiment thereof, as illustrated in the accompanying drawings.

BEST MODE FOR CARRYING OUT THE INVENTION

Figure 1:
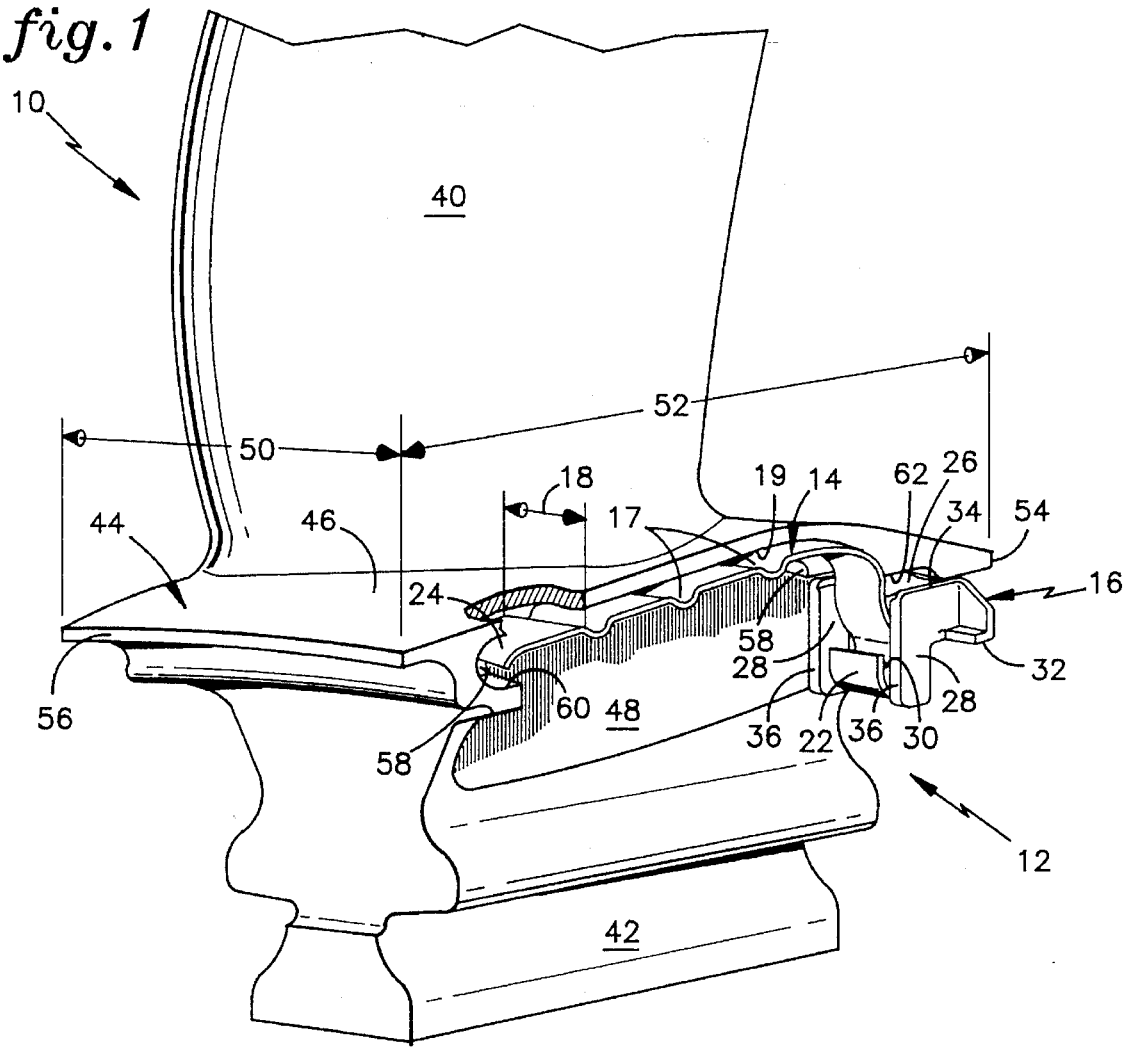
FIG. 1 is a perspective view of the seal and damper means of the present invention installed in a blade.

Referring to FIG. 1, a turbine blade 10 is shown with an apparatus 12 for: (1) sealing gaps between adjacent blades 10 of a turbine blade rotor assembly; and (2) damping vibrations of adjacent blades 10. The apparatus 12 includes a platform seal 14 and a damping block 16. The platform seal 14 comprises a thin plate body having a width 18, and a length defined by a first end 22 and a second end 24. The first end 22 of the platform seal 14 is formed into a hook shape. The platform seal 14 further includes a plurality of channels 17. In the preferred embodiment, the channels 17 are corrugations which extend across the width 18 of the seal 14. Alternatively, the channels 17 may assume different paths from an outer edge to a center region of the seal 14 and be formed by means other than corrugation.

Figure 2:
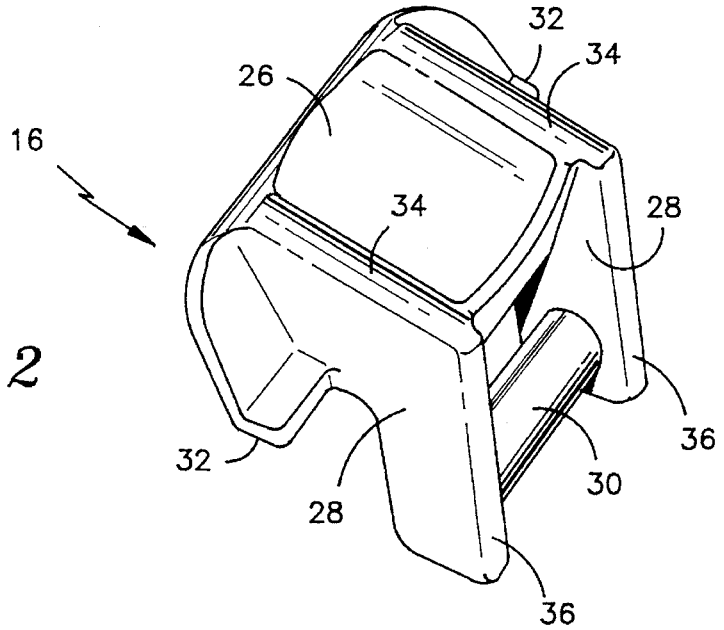
FIG. 2 is a perspective view of the damping block.

Referring to FIG. 2, the damping block 16 includes a body 26, a pair of flanges 28, a rod 30, and a windage surface 32. The body 26 includes a pair of friction surfaces 34 for contacting adjacent blades 10 (see FIG. 3). The flanges 28 are formed on opposite sides of the body 26 and each includes a section 36 extending out from the body 26. The rod 30 is fixed between the flange sections 36 extending out from the body 26.

Referring to FIG. 1, each turbine blade 10 includes an airfoil 40, a root 42, and a platform 44. The platform 44 extends laterally outward in the transition area between the root 42 and the airfoil 40 and may be described as having an airfoil side 46, a root side 48, a width 50, and a length 52 extending from a forward edge 54 to a rearward edge 56. 0n each lengthwise side, the platform 44 includes a pair of locating surfaces 58, a seal pocket 60, and a damping shelf 62 for receiving a friction surface 34 of the damping block 16. The locating surfaces 58 extend laterally outward from the lengthwise sides of the blade 10, on the root side 48 of the platform 44. The seal pocket 60 is formed in the rearward portion of the platform 44, on the root side 48 of the platform 44, with the opening of the pocket 60 facing toward the forward edge 54. The damping shelf 62 is formed in the forward section of the platform 44, also on the root side 48.

Figure 3:
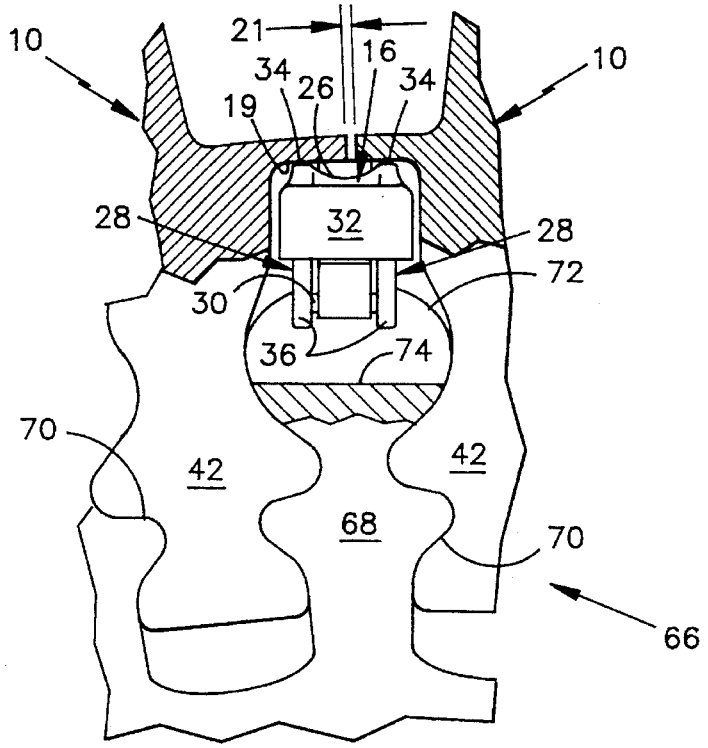
FIG. 3 is a sectional view of the blades and disc of a rotor assembly with the seal and damper means of the present invention installed between adjacent blades.
Figure 5:
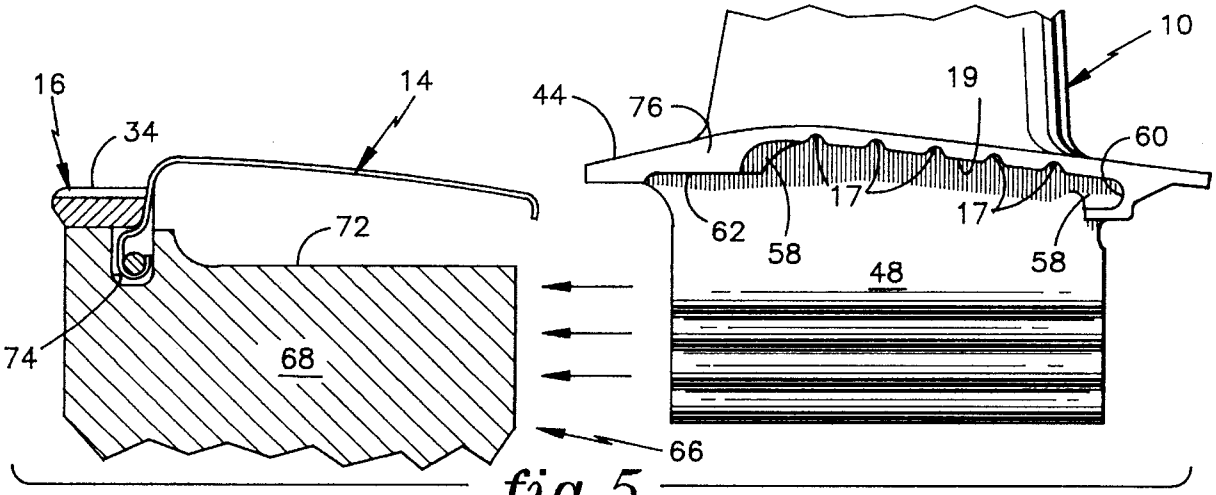
FIG. 5 illustrates the seal and damper means of the present invention mounted in a disc. The arrows indicate how the blade is assembled with the present invention installed in the disc. This figure shows an alternative embodiment of the means for conducting secondary fluid flow between the seal and the root side surfaces of the platforms.
Figure 6:
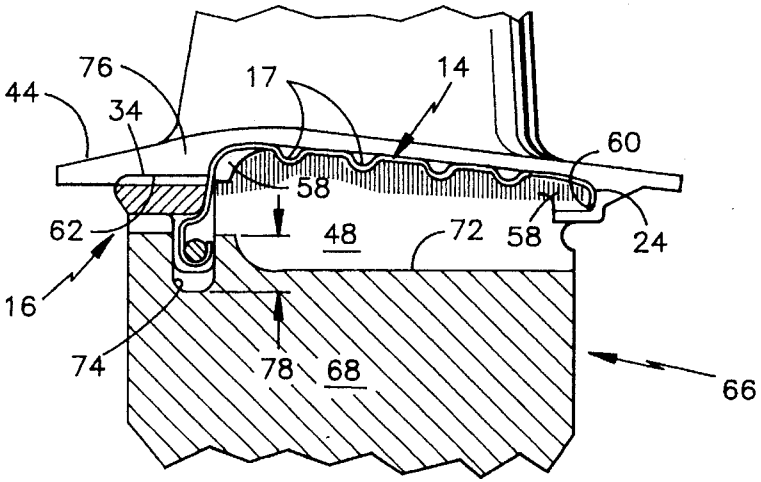
FIG. 6 is a sectional view of the blade and the seal and damper means of the present invention assembled with the disc.

Referring to FIG. 3, a section of a turbine blade rotor assembly 66 includes a pair of adjacent turbine blades 10 mounted in a disc 68. The disc 68 includes a plurality of recesses 70 circumferentially distributed in the outer surface 72 of the disc 68 for receiving the roots 42 of the turbine blades 10. FIG. 3 shows the roots 42 and recesses 70 having a conventional fir tree configuration. The disc 68 further includes an annular slot 74 disposed in the outer surface 72 of the disc 68 for receiving damping blocks 16. FIGS. 5 and 6 show the annular slot 74 from a side view.

Figure 4:
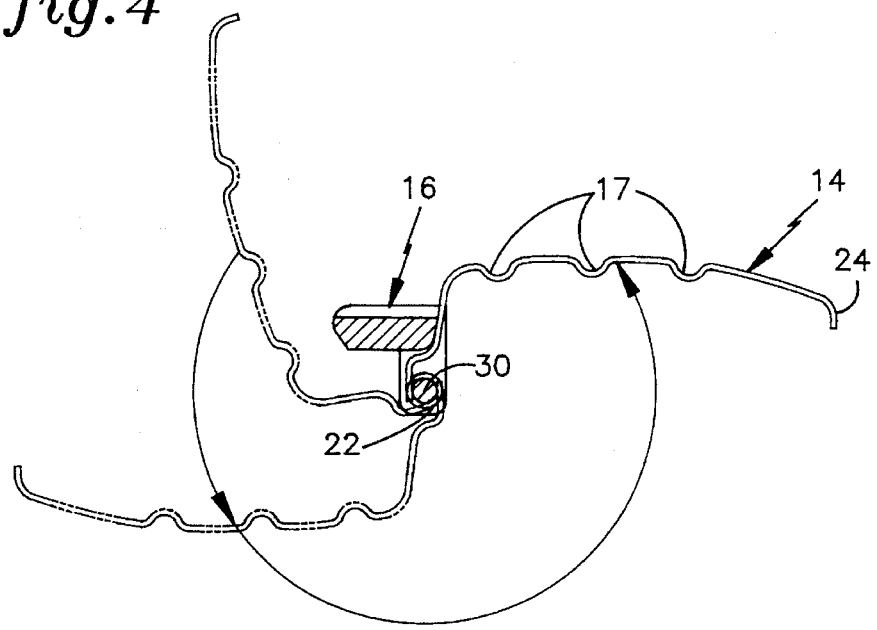
FIG. 4 illustrates how the seal and damper means are joined.

Referring to FIGS. 4–6, the turbine blade rotor assembly 66 may be assembled by first joining the platform seals 14 and the damping blocks 16 as is shown in FIG. 3. The rod 30 of the damping block 16 is received within the hook-shaped first end 22 of the platform seal 14 and the seal 14 is rotated into a position where the damping block 16 prevents the seal 14 and block 16 from disengaging.

A first turbine blade 10 is installed in the disc 68. The coupled platform seal 14 and damping block 16 are placed within the annular slot 74 of the disc 68 and slid laterally into engagement with the installed blade 10. Specifically, the second end 24 of the platform seal 14 is received within the seal pocket 60 and the platform seal 14 is slid into contact with the lateral locating surfaces 58. At this point: (1) the second end 24 of the platform seal 14 is maintained in a particular radial position by the seal pocket 60; (2) the weight of the damper block 16 maintains the first end 22 of the platform seal 14 and the damper block 16 at the lowest radial position within the annular slot 74 (Shown in FIG. 5); and (3) the lateral locating surfaces 58 maintain approximately one-half of the width 18 (see FIG. 1) of the platform seal 14 laterally outside the lengthwise side edge 76 of the platform 44. The depth 78 of the annular slot 74 permits the coupled platform seal 14 and damping block 16 to be in place and yet not interfere with the installation of the adjacent turbine blade. The lateral location of the locating surfaces 58 ensures that approximately one half of the platform seal 14 will be exposed to the adjacent blade. The adjacent blade is subsequently slid into position, over the exposed platform seal 14. The seal pocket 60 of the first blade 10 maintains the second end 24 of the platform seal 14 in the proper position to be received by the seal pocket 60 of the adjacent blade. The installation process described heretofore is repeated for every turbine blade 10.

Referring to FIG. 6, after installation is complete and the turbine blade rotor assembly 66 is rotated within the turbine engine (not shown), centrifugal forces force the coupled damper block 16 and platform seal 14 to translate radially outward into contact with the root side surfaces 19 of each platform 44, as is shown in FIGS. 3 and 6. In this position, the channels 17 within the platform seal 44 provide means for conducting secondary flow between the thin plate body of the platform seal 44 and the root side surfaces 19 of the platforms 44. In the preferred embodiment, the flow may enter either side of the platform seal 44 width 18 and exit through the gap 21 between the platforms 44 (see FIG. 3) and into the primary flow. In alternative embodiments, the channels 17 may extend from any side of the platform seal 14 through to a central region of the seal 14 that is exposed to the gap 21 between the adjacent platforms 44.

Although this invention has been shown and described with respect to the detailed embodiments thereof, it will be understood by those skilled in the art that various changes in form and detail thereof may be made without departing from the spirit and scope of the claimed invention. As an example, the best mode of the present application has been heretofore described in terms of a plurality of channels 17 being formed in the platform seal 14 as a means for conducting secondary flow between the thin plate body of the platform seal 14 and the root side surfaces 19 of the adjacent platforms 44. In an alternative embodiment, the channels 17 may be formed in the root side surfaces 19 of the platforms 44, as is shown in FIG. 5. The channels 17 in the platform 44 extend laterally inward beyond the lateral locating surfaces 58 to ensure that the platform channels 17 are exposed to the secondary flow passing thereby.

As a further example, the platform seal 14 has heretofore been described in terms of a seal coupled with a damping block. The apparatus for sealing a gap between adjacent blades, having means for conducting secondary flow between the thin plate body and root side surfaces of adjacent blade platforms, and thereafter into the gap, may alternatively comprise seals other than those coupled with damping blocks.

I claim:

1. An apparatus for sealing a gap between adjacent blades in a rotor assembly for a gas turbine engine, the rotor assembly including a plurality of blades circumferentially disposed around a disc, each of the blades having an airfoil, a root, and a platform extending outward in a lateral direction in a transition area between the root and the airfoil, the gap being formed between edges of adjacent platforms, wherein the platforms collectively form a flow path for primary fluid flow passing by the airfoil side of the platforms and secondary fluid flow passing by the root side of the platforms, said apparatus comprising:

a body, having a length and a width;

a plurality of channels, formed as corrugations in said body, extending between widthwise edges of said body;

wherein secondary flow may enter said channels from said edges, pass between said body and the root side surfaces of the platforms, and exit into the gap, thereby transferring thermal energy away from the platforms.

2. A rotor assembly for a gas turbine engine, comprising:

a plurality of blades, each of said blades having an airfoil, a root, and a platform extending outward in a lateral direction in a transition area between said root and said airfoil of each blade;

a disc, having an outer surface which includes a plurality of recesses uniformly and circumferentially distributed around said disc, for receiving said blade roots adjacent one another;

wherein said platforms of adjacent blades collectively form a flow path for a primary fluid flow passing by said airfoil side of said platforms and a secondary fluid flow passing by said root side of said platforms, wherein said platforms are separated by a gap;

a plurality of seals, each seal including:

a body, having a length and a width; and a plurality of channels, formed as corrugations in said body, extending between widthwise edges of said body;

wherein secondary flow may enter said channels from said edges and pass between said body and root side surfaces of said platforms and exit into said gap, thereby transferring thermal energy away from said platforms.

* * * * *